US008651915B2

(12) United States Patent
Irmler et al.

(10) Patent No.: US 8,651,915 B2
(45) Date of Patent: Feb. 18, 2014

(54) METHOD AND APPARATUS FOR CONTROL OF A FLEXIBLE MATERIAL USING MAGNETISM

(75) Inventors: Holger Irmler, Studio City, CA (US); Philip Jackson, Glendale, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 13/540,473

(22) Filed: Jul. 2, 2012

(65) Prior Publication Data

US 2013/0005492 A1 Jan. 3, 2013

Related U.S. Application Data

(63) Continuation of application No. 12/346,470, filed on Dec. 30, 2008, now Pat. No. 8,210,893.

(51) Int. Cl.
*A63H 33/26* (2006.01)
*A63F 9/34* (2006.01)

(52) U.S. Cl.
CPC .. *A63H 33/26* (2013.01); *A63F 9/34* (2013.01)
USPC ..... 446/135; 446/129; 446/131; 446/132; 446/133; 446/139; 472/57; 335/219; 335/296; 40/426; 273/239

(58) Field of Classification Search
CPC ..... A63H 33/26; A63F 9/34
USPC ..... 446/129, 131, 132, 133, 135, 139; 472/57; 335/219, 296; 40/426; 273/239
See application file for complete search history.

(56) References Cited

U.S. PATENT DOCUMENTS

| | | | | | |
|---|---|---|---|---|---|
| 2,746,206 | A | * | 5/1956 | Hammond, Jr. | 40/426 |
| 2,811,356 | A | * | 10/1957 | Reed | 434/134 |
| 2,836,931 | A | * | 6/1958 | Brennan | 446/132 |
| 3,906,658 | A | * | 9/1975 | Gross | 446/92 |
| 3,974,731 | A | * | 8/1976 | Joslyn | 84/404 |
| 4,132,032 | A | * | 1/1979 | Triska | 446/132 |
| 4,579,882 | A | | 4/1986 | Kanbe et al. | |
| 4,776,979 | A | | 10/1988 | Kageyama | |
| 4,964,830 | A | * | 10/1990 | Wagner | 446/71 |
| 5,057,363 | A | * | 10/1991 | Nakanishi | 428/321.5 |
| 5,152,711 | A | * | 10/1992 | Gross | 446/139 |
| 5,153,254 | A | | 10/1992 | Chen | |
| 5,411,398 | A | * | 5/1995 | Nakanishi et al. | 434/409 |
| 5,587,102 | A | * | 12/1996 | Stern et al. | 427/131 |
| 5,810,640 | A | * | 9/1998 | Clarke et al. | 446/132 |
| 6,033,283 | A | | 3/2000 | Chen | |

(Continued)

OTHER PUBLICATIONS

Author Unknown, "Bio-Medical Ferrofluids", http://www.ferrotec.com/products/ferrofluid/bioMedical, at least as early as Dec. 30, 2008, 1 page.

(Continued)

*Primary Examiner* — Gene Kim
*Assistant Examiner* — Alexander Niconovich
(74) *Attorney, Agent, or Firm* — Dorsey & Whitney LLP

(57) ABSTRACT

One embodiment may take the form of a flexible creation animated by magnets or electromagnets brought near the flexible creation. Iron particles blended with a flexible material of the flexible creation may interact with the magnetic fields generated by the magnets, causing the object or portions of the object to move toward or away from the controlling magnets, thereby animating the object.

20 Claims, 15 Drawing Sheets

(56) References Cited

U.S. PATENT DOCUMENTS

| | | | | |
|---|---|---|---|---|
| 6,062,938 | A * | 5/2000 | Meng-Suen | 446/134 |
| 6,158,157 | A * | 12/2000 | Hiscock et al. | 40/661.01 |
| 6,290,894 | B1 * | 9/2001 | Raj et al. | 264/405 |
| 6,572,431 | B1 * | 6/2003 | Maa | 446/301 |
| 7,402,622 | B1 | 7/2008 | Lombardi | |
| 7,935,297 | B2 * | 5/2011 | Pugel | 264/427 |
| 2002/0102905 | A1 | 8/2002 | Tseng | |

OTHER PUBLICATIONS

Author Unknown, "Elastomer", Wikipedia, http://en.wikipedia.org/wiki/Elastomer, at least as early as Dec. 5, 2008, 3 pages.

Author Unknown, "Electromagnet", Wikipedia, http://en.wikipeda/wiki/Electromagnet, at least as early as Dec. 8, 2008, 8 pages.

Author Unknown, "Peristaltic pump", Wikipedia, http://en.wikipeda/wiki/Peristaltic_pump, at least as early as Nov. 4, 2008, 3 pages.

Author Unknown, "Pulse-width modultation", Wikipedia, http://en.wikipeda/wiki/Pulse-width_modulation, at least as early as Dec. 8, 2008, 6 pages.

Bonsor, K., "How Smart Structures Will Work", http://www.howstuffworks.com/smart-structure1.htm, at least as early as Nov. 18, 2008, 2 pages.

Gokturk, et al., "Electric and Magnetic Properties of a Thermoplastic Elastomer Incorporated with Ferromagnetic Powders", IEEE Transactions on Magnetics, 29:6, Nov. 1993, 4170-4176.

Seeberger, "Ferro-Magnetic Ballet", http://www/mccmedia.com/pipermail/brin-1/Week-of-Mon-20070402/138491.html, Apr. 2, 2007, 2 pages.

* cited by examiner

METHOD AND APPARATUS FOR CONTROL OF A FLEXIBLE MATERIAL USING MAGNETISM

CROSS-REFERENCE TO RELATED APPLICATIONS

The present application is a continuation application of U.S. patent application Ser. No. 12/346,470, filed Dec. 30, 2008, entitled "Method and Apparatus for Control of a Flexible Material Using Magnetism", and which is incorporated herein in its entirety and for all purposes.

FIELD OF THE INVENTION

Aspects of the present invention relate to animation or puppetry of three dimensional characters. More particularly, aspects of the present invention involve the creation of flexible objects with embedded iron particles such that the objects may be animated or controlled through magnetism.

BACKGROUND

Flexible objects or shapes are often utilized by amusement parks to create colorful characters or displays to entertain and interact with the patrons of the park. For example, a three-dimensional, life-sized sculpture based on a cartoon character, such as a cartoon dog or alien, may be constructed of a flexible material, such as an elastomer. Elastomers are polymer-based substances with the property of elasticity that can be molded into different shapes and objects. Further, because of the flexibility of the elastomers, the molded characters or objects may be animated to interact with the patrons of the amusement park. For example, an appendage of a character sculpture may be moved or animated to create the illusion that the character is waving or otherwise interacting with the patrons. In a similar manner, a display containing several elastomer objects or shapes may be combined to provide an entertaining and interactive show to the patrons.

Several techniques may be utilized to animate the flexible objects or characters of the amusement park. For example, the flexible objects or characters may include a system of actuators and motors embedded within the objects to provide animation of the objects. Another technique may involve embedding a hard magnet with a first polarity within a portion of the flexible object. To animate the object, a second magnet of opposite polarity may be brought near the embedded magnet to attract the embedded magnet and force the elastomer object to flex to bring the magnets together. However, over time, the force of the attraction between the magnets may cause the elastomer around the magnet to weaken, possibly resulting in the embedded hard magnet to rip or tear through the elastomer material.

SUMMARY

One implementation may comprise a sculpted character for entertaining a viewer. The sculpted character may comprise an elastic base material molded into the shape of the character and metal particles blended with the elastic base material in at least a portion of the shape of the character. Further, the metal particles blended with the elastic base material may react to a magnetic field generated by a drive magnet positioned near the character, such that the reaction of the metal particles may animate at least the portion of the shape of the character.

Another implementation may comprise an apparatus for animating a sculpted object. The apparatus may comprise a display structure defining an inner surface and an outer surface and a sculpted object coupled to the outer surface of the display structure. The sculpted object may be at least partially composed from a blend of metal particles and a flexible elastomer material. The apparatus may further comprise at least one drive magnet coupled to the inner surface of the display structure, wherein a magnetic field generated by the at least one drive magnet may attract the metal particles blended with the flexible elastomer material to animate the sculpted object.

A further implementation may comprise a method for sculpting an object. The method may include blending fine metal particles into a silicone base, generating a magnetic field using at least one magnet and orienting a flat surface near the at least one magnet, such that the magnetic field generated by the at least one magnet passes through the flat surface in a substantially perpendicular manner. The method may also include dripping the blending silicone and metal particles into the magnet field, wherein the metal particles blended into the silicone base align within in the magnetic field such that the silicone base forms a shape substantially similar to the magnetic field.

DETAILED DESCRIPTION

Implementations of the present invention may involve a flexible material infused with fine iron particles to form at least a portion of a flexible character or object. The flexible material may be molded to form a sculpture or shape for display or entertainment to a viewer. Further, the flexible creation may be animated by one or more drive magnets brought near the flexible creation such that the iron particles blended with the flexible material may interact with the magnetic fields generated by the magnets. The infused iron particles may be attracted to or repelled from the drive magnets, causing the object or at least a portion of the object to move toward or away from the controlling magnets, thereby animating the object or portions of the object. The drive magnets used to animate the character or object may be one or more hard magnets or one or more electro-magnets located near the object, with each drive magnet controlled manually, mechanically or programmably. Further, several drive magnets may be used to provide several magnetic fields to act on the object for a more nuanced animation of the object.

Another implementation may use a magnetic field of a magnet to create an iron-infused flexible plant-like object that may be animated by a magnet. The object may be constructed of a flexible iron-infused material that is introduced into the magnetic field while the material is in a liquid or semi-liquid state. The iron filings blended within the flexible material may generally align with the magnetic field such that the object may take at least a portion of the shape of the magnetic field and hold that shape until the material has solidified. In this manner, a plant-like sculpture with several leaves may be created that approximates the magnetic field in which the sculpture was created.

Figure 1:
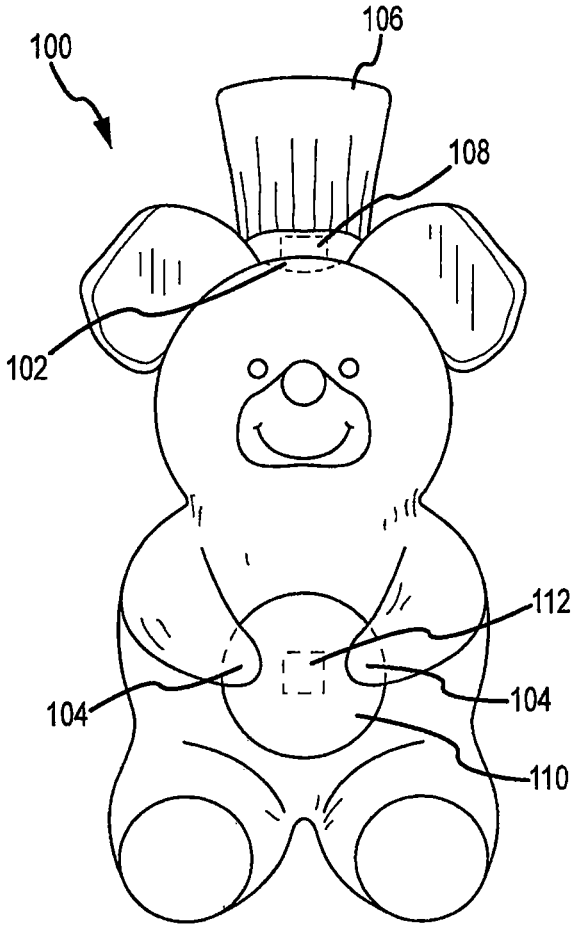
FIG. 1 is a diagram illustrating a molded sculpture of a character at least partially composed of a flexible material infused with iron particles such that the character may be animated through magnetism.

As mentioned, a character or object may be created and animated using a flexible material infused with iron particles. For example, FIG. 1 is a diagram illustrating a sculpture of a cartoon character 100 at least partially constructed with a flexible, metal-infused material, such as a silicon base blended with iron particles. The character 100 may also be animated by utilizing magnetism to move various features of the character. Magnetism may also be utilized to attach accessories or the like to the character.

The flexible, iron-infused material of the character 100 may be created from any flexible base material that can be blended with metal particles and molded into the shape of the character. For example, the flexible iron-infused material may include a base material of platinum-cured silicon, condensation-cured silicon, foam urethane or foam silicone. This base material may be combined and blended with fine iron particles such that the object may be subject to a magnetic field. In one example, one to nine micrometer iron 101 particles may be blended with the base material while the base material is in a liquid or semi-liquid state. The amount of iron particles mixed with the base material may by twice the weight of the base material. Thus, five grams of condensation-cured silicon may be mixed with ten grams of fine iron particles to create the flexible iron-infused material described herein. Further, rather than evenly distributing the iron particles throughout the base material, other implementations may provide for higher concentrations of the iron particles in particular locations of the character, if desired. Thus, the character may be created with one or more densities of iron particles blended with the base material.

Once the flexible iron-infused material is blended, the material may be molded into any of a variety of objects or sculptures. Further, because the flexible material is blended with iron particles, the object or sculpture may react to magnetic forces applied to the material. Thus, once the object is cured, one of more drive magnets may be utilized to animate the object or character by applying the generated magnetic field to the object. While the blend described includes fine iron particles, generally, any flexible material infused with particles that are subject to a magnetic field may be used with the implementations described herein.

Further, it is not necessary that the entire object or sculpture be constructed from the flexible iron-infused material. Instead, the object may be in part constructed of an unblended base material with selected portions of the object including the iron-infused blend. For example, the character sculptor 100 of FIG. 1 may be largely constructed of a condensation-cured silicon, with selected portions constructed of iron-infused silicon bonded to or integrated with the main sculpture. Thus, the portions of the character outlining the top of the character's head 102 and the tips of the character's paws 104 may be created using the flexible, iron-infused material. The rest of the character 100 may be created using a base flexible material, such as platinum or condensation-cured silicon. In other implementations, the character may be in part constructed from a second material having several different properties as that of the base material, such as a hard plastic that may be substantially rigid. In either case, the flexible iron-infused material portions 102,104 of the character 100 may be bonded to the non-blended character to create a continuous piece. Once bonded together, the multiple portions may be painted to give the character 100 a continuous look. In alternative implementations, the entire character sculptor 100 may consist of the flexible, iron-infused material.

As described, the flexible, iron-infused portions 102,104 of the character 100 may react to a magnetic field generated by a drive magnet in the vicinity of the portions. For example, a hard magnet 108 may be placed within an accessory to the character 100, such as a hat 106 intended to be placed atop the character's head. The magnet 108 may prevent the hat 106 from falling off of the character's head as the iron particles within the iron-infused portion 102 of the character 100 are attracted to the magnet. Thus, the magnet may assist in retaining the hat 106 in the proper position atop the character's head 102. In a similar manner, any number of accessories may be attached to the character 100 by placing a drive magnet within the accessory and attaching the accessory to a section of the character constructed of the flexible iron-infused material.

In another implementation, sections of the character 100 may be animated in reaction to a magnetic force. In one example, the tips of the character's hands or paws 104 may be constructed of the flexible, iron-infused material. An accessory, such as a ball 110, may include a drive magnet 112 embedded within the accessory, similar to the hat example described above. When the ball 110 containing the magnet 112 is brought near the character's hands 104, the arms of the character 100 may move to grasp the ball 110 in reaction to the magnetic field of the magnet. This action may occur as the ball 110 is placed near the character 100 or is thrown to the character. Thus, the character 100 may appear to move its arms to catch the ball 110 as it approaches the character. Further, once the hands 104 of the character 100 are in contact with the ball 110, the ball may remain grasped between the hands as the magnetic forces of the iron filings and the magnet continue to attract. In another implementation, the ball 110 may be instead constructed of a flexible iron-infused material, such as an iron-infused foam urethane rather than contain an embedded magnet. In such an implementation, the iron particles of the ball 110 may be magnetized such that they may interact accordingly with the flexible iron-infused material of the character's hands 104 to catch and grasp the ball.

Further, in some implementations, the flexible object may include several portions composed of different densities of iron particles. For example, the character 100 of FIG. 1 may be comprised of several sections, with each of the sections including different ratios of iron particles mixed with the base flexible material. For example, the head portion 102 may include a weight of iron particles that equals twice the weight of the base material, i.e. ten grams of iron particles blended with five grams of silicone or base material. However, the hands section 104 may include an equal blend of iron particles and base material. In other words, more iron particles may be blended in the head section 102 of the character 100 as in the hand section 104. Further, the rest of the character 100 may include no iron particles at all. Upon molding, the three sections may be bonded together to form the character 100 with the different portions of iron densities. In other implementations, the entire character, including the separate density portions, may be cast as a single object in the same mold or as a mixture of both the single cast object and bonded portions.

The different densities of the sections of the character 100 may provide certain features to the animation of the character. For example, a higher density section, including more iron particles, may be stiffer than sections with less iron particles, but may provide a stronger attraction to a magnetic field. Conversely, sections with less iron particles may be more flexible and more durable, but may be less attracted to a magnetic field. Thus, because the head 102 of the character 100 of FIG. 1 does not animate, the head portion may be constructed with a high density of iron particles blended with the base material to strongly attract the magnet 108 located within the accessory 106. Alternatively, the hand sections 104, which do animate in response to the magnet 112 within the ball 110, may be of a lesser density such that the hands may move to contact the ball. Thus, the density of any section of a character may be determined in response to the intention of the section, weighing flexibility, durability and attraction to the magnetic field of a magnet. In other embodiments, the density of a section of the character or object may be selected based on weight considerations. For example, in a tree object constructed at least partially of iron-infused, flexible material, a branch may extend outwardly from a tree trunk. However, the higher density of iron particles blended with the base material, the heavier the section may be. Thus, the density of the sections of the branch may be chosen such that the branch does not become too heavy to be supported by the rest of the tree object.

Figure 2A:
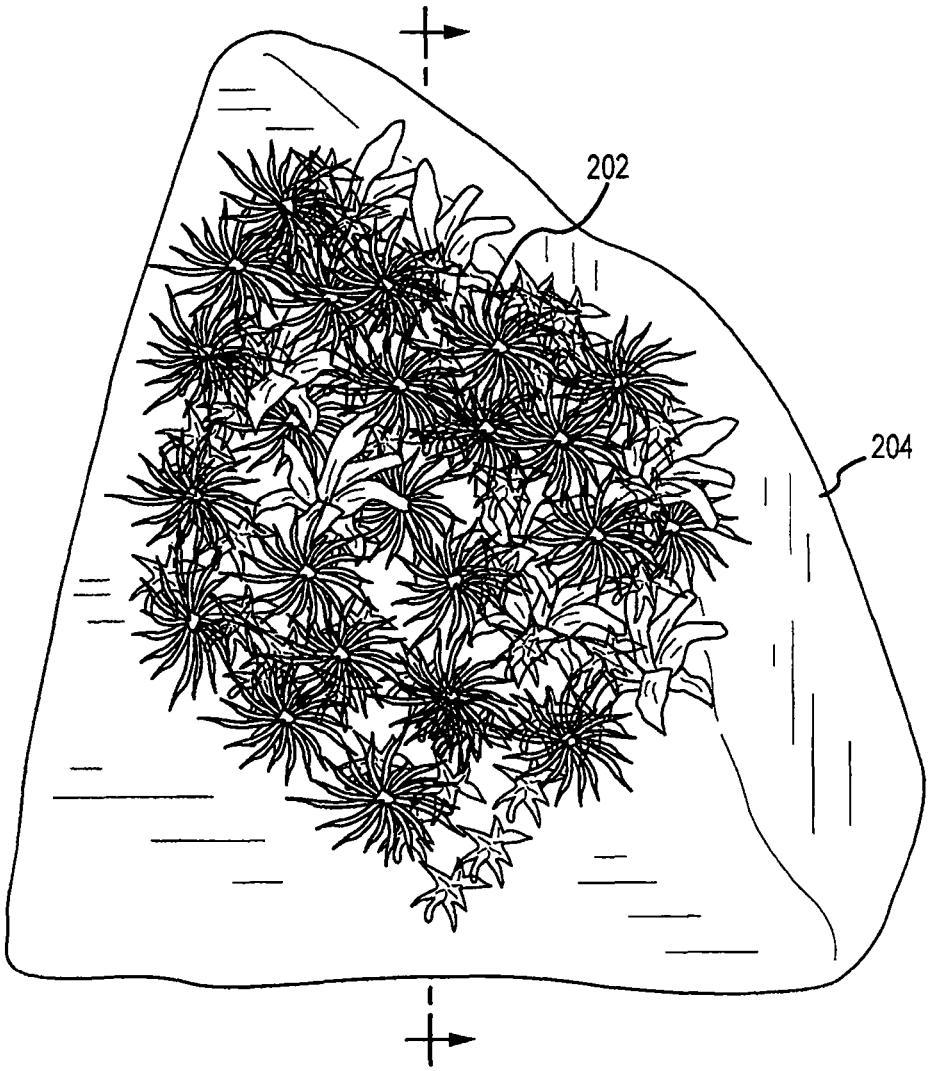
FIG. 2A is a diagram illustrating several plant-like flexible objects constructed of an iron-infused flexible material mounted on a structure such that the objects may be animated through magnetism.
Figure 2B:
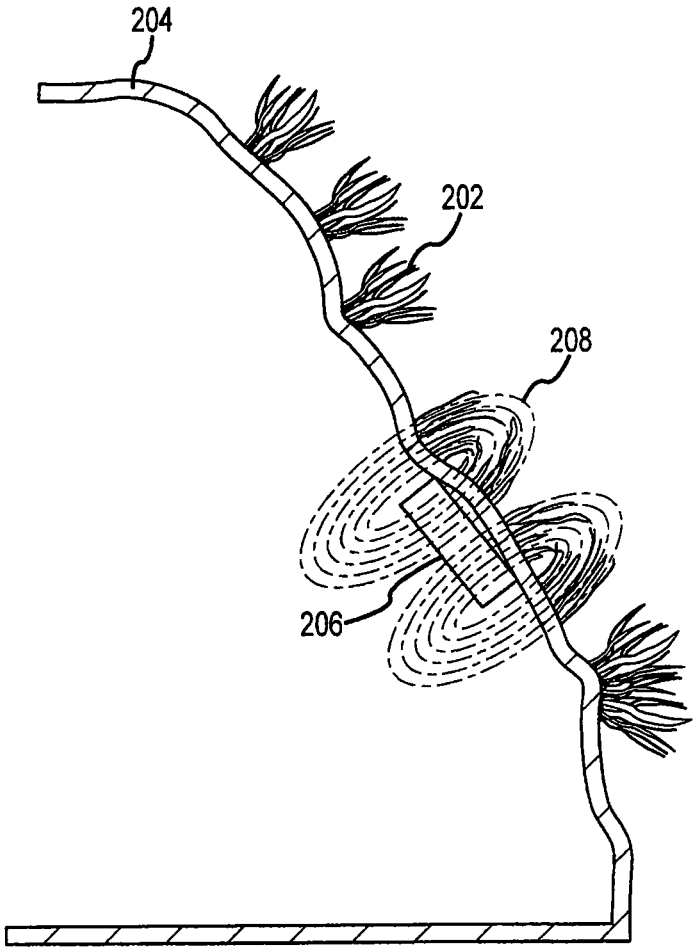
FIG. 2B is a cross-section of the diagram of FIG. 2A illustrating utilizing a magnet to animate the iron-infused flexible material mounted on the structure.

Other implementations may utilize several objects or characters constructed of a flexible, iron-infused material to create an animated display. FIG. 2A is an example of several plant-like flexible objects constructed of an iron-infused flexible material, such that the objects may be animated using one or more drive magnets. The plant objects 202 of FIG. 2 may be mounted on a display structure 204 such that a viewer may observe the objects and any movements or animations of the objects. For example, the display structure 204 may be a wall or other surface that may be viewed by a viewer. Further, the structure 204 may appear to a viewer as a rock or other natural object to create the illusion that the plant objects 202 are growing from the display structure 204.

In one example, the plant objects 202 may be mounted on an outer surface of the display structure 204 while one or more drive magnets may be positioned on the inner surface of the structure. Thus, in a wall display, the magnets may be positioned on the inner surface of the wall, hidden from view of the viewers of the display. In the rock display configuration shown in FIG. 2B, the display structure 204 may be hollow to allow a drive magnet 206 to be positioned near the inner surface of the structure 204. As shown, the drive magnet 206 may be a hard magnet that may be pressed up against the inner surface of the structure 204, directly behind the plant objects 202. However, it is not required that the magnet be pressed against the inner surface of the display structure 204. Rather, the one or more drive magnets may be located anywhere that allows the magnetic fields 208 of the magnet 206 to interact with the plant-like objects 202.

To facilitate the magnetic fields 208 of the drive magnet 206 to affect the iron particles of the plant objects 202, the width of the structure 204 should be thin enough to allow the magnetic fields of the one or more drive magnets to pass through the structure and interact with the objects 202 mounted on the opposite surface. Thus, in this configuration, as the one or more drive magnets 206 may be moved along the inner surface of the display structure 204, the iron particles of the plant objects 202 mounted on the outer surface may react to the introduced magnetic fields 208 and animate accordingly.

Figure 3A:
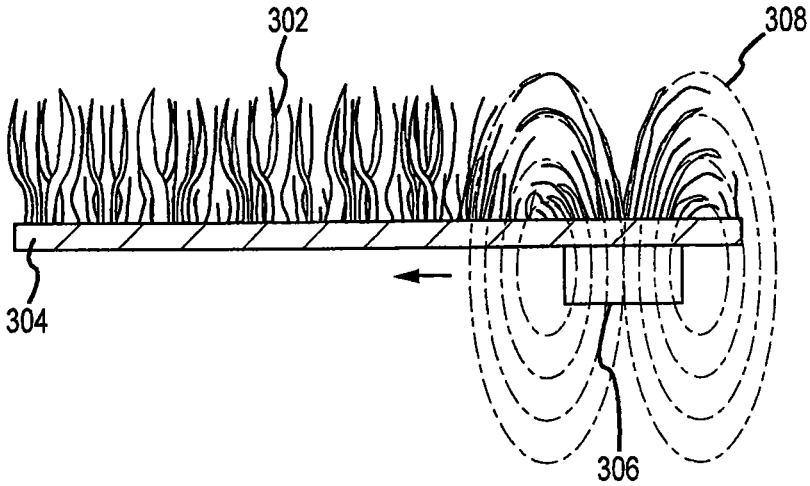
FIG. 3A is a cross section of the structure of FIG. 2 illustrating the animation of the plant-like object constructed of a flexible iron-infused material in reaction to a magnetic field produced by a drive magnet.

For example, FIG. 3A is a cross section of the structure of FIG. 2 illustrating the animation of the plant-like object 302 constructed of a flexible iron-infused material in reaction to a drive magnet 306 moving along the inner surface of the display structure 304. Initially, the iron particles embedded within the plant object 302 may interact with the magnetic fields 308 created by the magnet 306. Thus, as shown, the leaves of the plant object 302 may bend towards to the structure surface in response to the placement of the drive magnet 306 on the right side of the object as the iron particles are attracted to the magnetic field 308. It should be noted that the leaves of the plant object 302 may bend to both the left and right in response to the dual magnetic fields emanating from the drive magnet 306. The leaves on the left side of the object 302, however, may not initially react to the placement of the magnet 306 on the right side of the object and may maintain their shape.

Figure 3B:
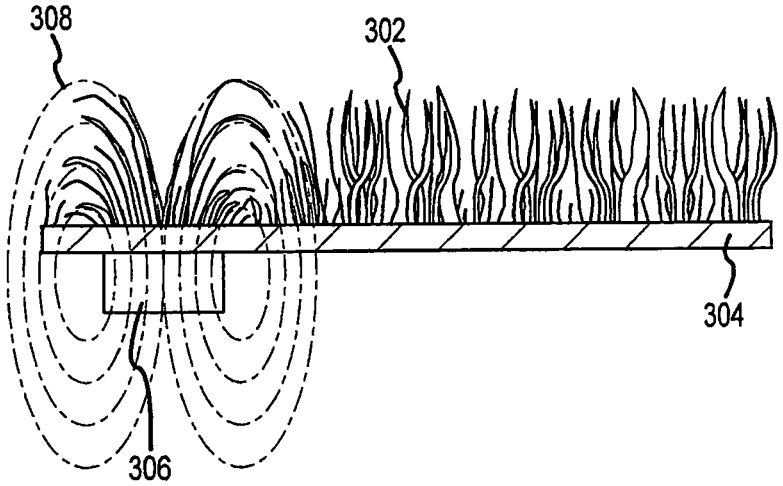
FIG. 3B is a cross section of the structure of FIG. 3A illustrating the animation of the plant-like object as the drive magnet is moved along the inner surface of the structure.

To provide the wave-like motion of the plant object 302, the drive magnet 306 may be moved from one side of the object to the other along the inner surface of the display structure 304, as shown in FIG. 3B. As the magnet 306 is moved from right to left along the inner surface of the display structure 304, the magnetic fields 308 of the drive magnet may follow the movement. Thus, as the magnetic fields shift from right to left in response to the movement of the magnet 306, the leaves of the object 302 on the right side of the object may return to their starting position as the magnetic field 308 of the magnet is moved away from that portion of the object. However, as the magnet 306 approaches, the leaves on the left side of the object 306 may react to the introduced magnetic field 308 and may bend toward the surface of the structure. In this manner, the leaves of the plant objects 302 may be animated by the movement of a magnet 306 along the inner surface of the display structure 304.

This movement of the plant object 302 in reaction to the movement of the one or more drive magnets 306 along the inner surface of the display structure 304 may provide the illusion that the plant object are underwater swaying in motion with a wave, providing the plant object with a "dry for wet" look. The movement of the plant object 302 in reaction to the one or more magnets 306 may also provide the appearance that the object is swaying in motion in response to wind. Further, several plant-like objects may be mounted on the display structure 304 and may be all moved in a similar manner by several drive magnets. Thus, the combined movement of the several plant-like objects 302 by several drive magnets 306 moving along the inner surface of the display structure 304 may create the illusion of an underwater scene on a wall or other structure to entertain a viewer.

Figure 4A:
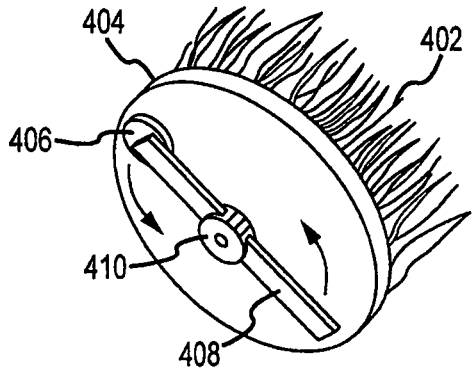
FIG. 4A is an isometric view of a diagram illustrating a cross-section of a structure similar to that of FIGS. 3A and 3B with a magnet coupled to an arm device to move the magnet along the inner surface of the structure.

Other implementations may use mechanical techniques, such as a mechanical drive mechanism, to move the one or more drive magnets along the inner surface of the display structure to animate the flexible iron-infused objects. FIG. 4A is an isometric diagram illustrating one example of such a mechanical drive mechanism. The figure shows a similar structure as that of FIGS. 3A and 3B with a magnet 406 coupled to an arm device 408 to move the drive magnet along the inner surface of the structure. In this implementation, the magnet may be attached to an arm 408 that may be rotated around the base of a plant object 402 constructed of flexible, iron-infused material and mounted on the outer surface of the structure 404. As the magnet 406 is rotated, the flexible iron-infused material of the plant object 402 may react to the magnetic fields produced by the magnet and may move and sway accordingly. Thus, the movement of the plant object 402 may be similar to that described above with reference to FIGS. 2 and 3.

The arm device 408 of the implementation may be configured to rotate around an axis oriented perpendicular to the inner surface of the display structure 404. The axis may pass through the center of the arm device 408 such that the arm may rotate clockwise or counter-clockwise around the axis. A magnet 406 may be coupled to one end of the arm device 408 such that as the arm rotates around the axis, the magnet 406 also rotates in a clockwise or counter-clockwise fashion. The implementation may also include a knob 410 extending away from and coupled to the arm 408 along the axis.

Figure 4B:
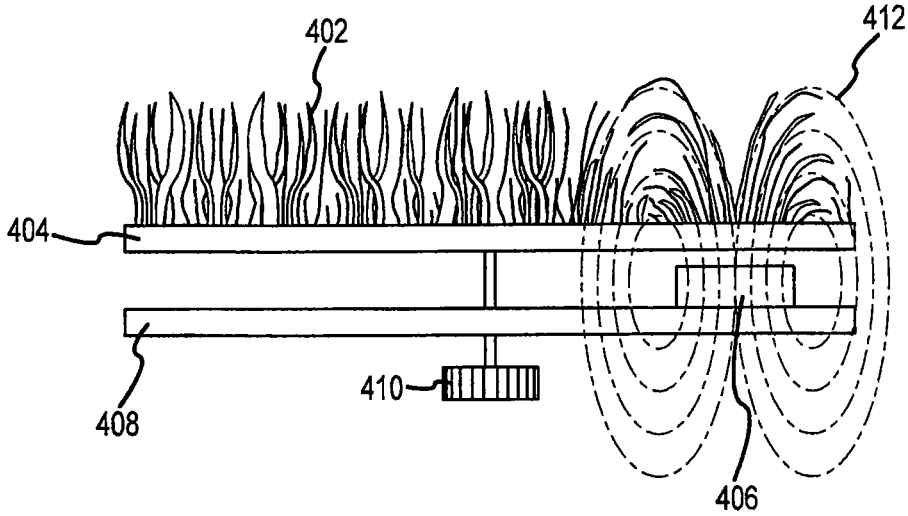
FIG. 4B is a diagram illustrating a cross-section of the structure of FIG. 4A with a magnet coupled to an arm device to move the magnet along the inner surface of the structure.

The operation of the mechanism may be seen in FIG. 4B. As shown, during operation the knob 410 may be spun in a clockwise or counter-clockwise fashion to rotate the arm device 408 and the magnet 406, thereby varying the magnetic fields 412 that interact with the plant object 402. As the magnetic fields 412 vary in relation to the movement of the magnet 406, the plant object 402 may sway or otherwise move in accordance to the varying magnetic fields. In one implementation, an operator may manually spin the knob 410 to rotate the magnet around the axis. In another implementation, the knob 410 may be coupled to a motor device that may spin the knob to create the swaying, animated effect of the plant object 402. Generally, many different mechanical drive mechanisms may be utilized to move the drive magnets under manual control or automated control.

Figure 5A:
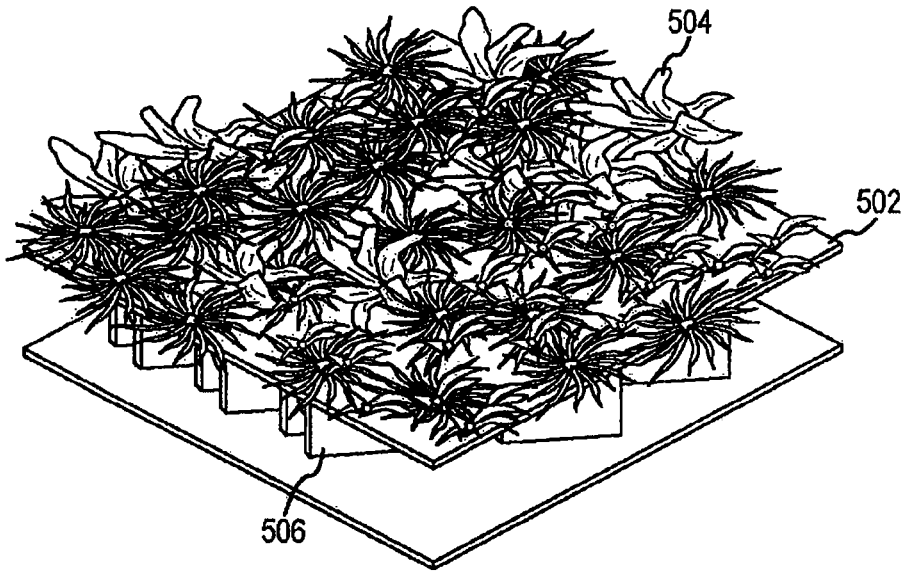
FIG. 5A is a diagram illustrating a structure for animating several plant objects constructed of a flexible iron-infused material using electromagnets created several magnetic fields.

Besides utilizing hard magnets as the drive magnets to animate an object constructed of flexible, iron-infused material, other implementations may utilize one or more electromagnets as drive magnets in place of the hard magnets. For example, FIG. 5A is a diagram illustrating a flat display structure 502 on which several plant objects 504 are mounted. The display structure 502 may be similar to that described above, such as a wall display or other display structure. Similar to the above implementations, one or more magnets may be located on the inner surface of the display structure 502 to animate the plant objects 504. However, in this implementation, several electromagnets 506 may be oriented to create several magnetic fields that run through the plant objects. To animate the objects 504, the electromagnets on the inner surface of the structure 502 may be switched on and off, or otherwise controlled, to create varying magnetic fields to approximate a swaying movement in the flexible iron-infused plant objects 504. For example, the electromagnets may be oriented on the inner surface of the flat structure 502 such that when several of the magnets are activated, the plant objects 504 may bend toward the structure 502 surface as the iron particles within the plant objects are attracted to the generated magnetic fields. At some point later, the conducting electromagnets may be switched off and several other magnets may be switch on. The second series of conducting magnets may be oriented to cause the plant objects 504 to sway or bend in an different direction in response to the newly generated magnetic fields. Thus, by switching from one series of magnets to the other, the plant objects 504 may appear to sway from side to side in response to the varying magnetic fields created by the electromagnets 506. The objects 504 may be animated to follow many varied patterns simply by orienting the electromagnets on the inner surface of the structure 502 and activating the magnets in a desired order.

Figure 5B:
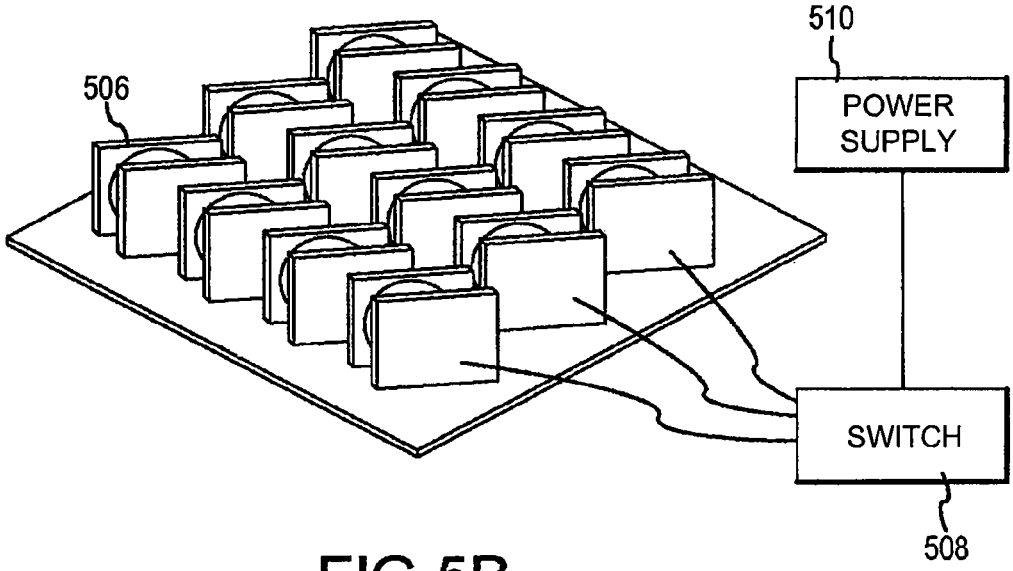
FIG. 5B is a diagram illustrating one possible orientation of the electromagnets on the inner surface of the flat structure to cause the plant objects to animate in response to the generated magnetic fields.

FIG. 5B is a diagram illustrating one possible orientation of the electromagnets 506 on the inner surface of the flat structure 502 to cause the plant objects 504 to animate in response to the generated magnetic fields. Each of the electromagnets 506 may be electrically coupled to a switch 508 that may, in turn, be coupled to a power supply 510. As explained in more detail below, the switch 508 may be configured to manually or programmably switch the electromagnets off and on. The operation of the electromagnets is explained in more detail below. It should be appreciated, however, that the electromagnets 506 may be oriented in any manner and any number of electromagnets may be utilized as desired by a designer to achieve a specific animation of the plant objects 504 mounted on the flat structure 502.

The electromagnets 506 in the implementation shown in FIGS. 5A and 5B may be controlled through a variety of means. For example, in one implementation, the electromagnets may be simply turned off and on manually by an operator. In this implementation, each electromagnet 506 may be coupled to a switch 508. The switch 508 may be used to activate and deactivate the electromagnets 506 as desired by an operator. Thus, the animation of the plant objects 504 in response to the generated magnetic fields of a single electromagnet 506 may generally take two positions, one when the magnet is conducting and one where the magnet is not. However, it should be appreciated that a single plant object 504 may respond to several electromagnets at once. Thus, each plant object 504 mounted on the display structure 504 may be animated by several electromagnets. In this manner, an operator may manually switch on and off the electromagnets 506 to achieve a desired animation of the iron-infused flexible objects 502.

Figure 5C:
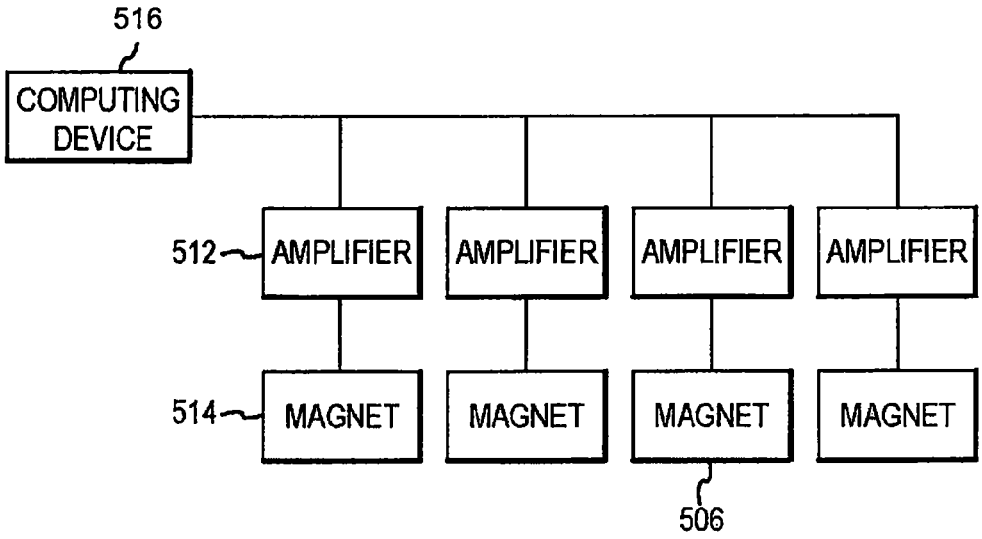
FIG. 5C is a block diagram of a system for a computing device to control the magnetic fields of several electromagnets.

Alternatively, the electromagnets 506 may be coupled to a computing device to control the magnetic fields generated by each electromagnet. FIG. 5C is a block diagram of system including a computing device 516 to control several electromagnets 506. The computing device 516 may be programmed to control the magnetic fields of the electromagnets 506 to provide various magnetic fields and produce animation in one or more objects constructed from iron-infused flexible material.

In the configuration of FIG. 5C, an amplifier 512 may be electrically coupled to each of the electromagnets 506. As should be appreciated, the magnetic field created by an electromagnet 506 is proportional to the amount of current provided to the magnet. Thus, the amplifiers 512 of FIG. 5C may control the strength of the magnetic field of each electromagnet 506 to which it is coupled. For example, the amplifiers 512 may provide current to electromagnet 514 to create a magnetic field around electromagnet 514. To remove the magnetic field of electromagnet 514, the amplifiers 512 may remove the current flowing to the magnet. In this manner, the amplifiers 512 may provide the current to each electromagnet 506 to activate or deactivate the magnetic field of each magnet.

The amplifiers 512 may also be coupled to a computing device 516 configured to control the activation and deactivation of the electromagnets. For example, the computing device may be programmed to create varying magnetic fields using the electromagnets. Thus, the computing device may send a signal to the amplifiers 512 to turn on a certain electromagnet at a particular time. In response, the amplifiers 512 may provide the necessary current to the correct electromagnet to create the magnetic field. Similarly, the computing device 516 may instruct the amplifiers 512 to turn off an electromagnet as a particular time. In this manner, the computing device may control the magnetic fields created by each electromagnet 506 and, in turn, control the animation of any iron-infused flexible objects within the vicinity of the electromagnets. The computing device may be any device that may be programmed to provide control signals to the amplifiers 512 to control the magnetic fields of the electromagnets.

The magnetic fields created by the electromagnets 506 may also vary in strength, providing a more variable magnetic field to the plant objects. For example, rather than a simple on and off configuration for each electromagnet as described above, the magnetic field of each electromagnet may be linearly proportional to the amount of electrical current flowing through the magnet. Thus, the amplifiers 512 may vary the amount of current provided to each electromagnet such that the magnetic fields created by the electromagnets may be variable. Linear analog magnetic fields of the electromagnets may provide a controller, such as an operator or computing device, with more control over the animation of the plant objects 504. Thus, rather than providing two positions for the plant objects in response to the on-and-off states of the electromagnets 506, a linear configuration may provide a range of movement for the objects. In a similar manner, a pulse-width modulation technique providing a series of current pulses sent to the electromagnets may create a linear magnetic field response and may provide a more "analog-like" control of the magnetic field of the electromagnets 506.

Figure 6A:
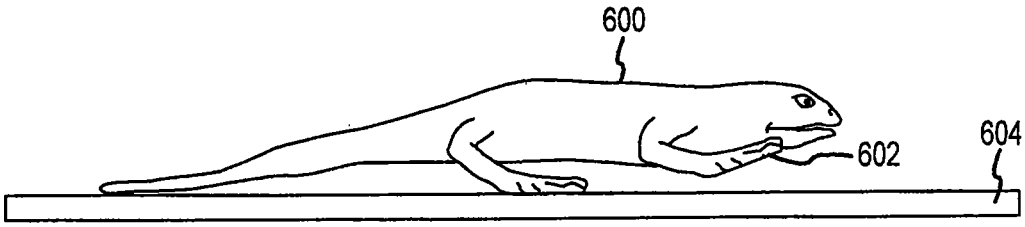
FIG. 6A is an diagram illustrating an animal object constructed from iron-infused, flexible material that may be animated through magnetism.

The techniques and implementations described herein to animate the plant-like objects constructed from iron-infused, flexible material may be also be applied to other objects constructed from iron-infused flexible material. For example, FIG. 6A is a diagram illustrating a character object constructed from iron-infused flexible material that may be animated through magnetism. Similar to the character of FIG. 1, the character 600 of FIGS. 6A and 6B may be entirely made of an iron-infused flexible material, or may contain selected portions constructed of flexible iron-infused material bonded to non-iron infused sections. For example, the lizard 600 of FIG. 6A may be constructed entirely of a silicone blended with fine iron particles. Alternatively, the body of the lizard 600 may be constructed of silicone while the front leg of the lizard 602 may be constructed of flexible iron-infused material and bonded to or integrally formed with the body of the lizard.

Figure 6B:
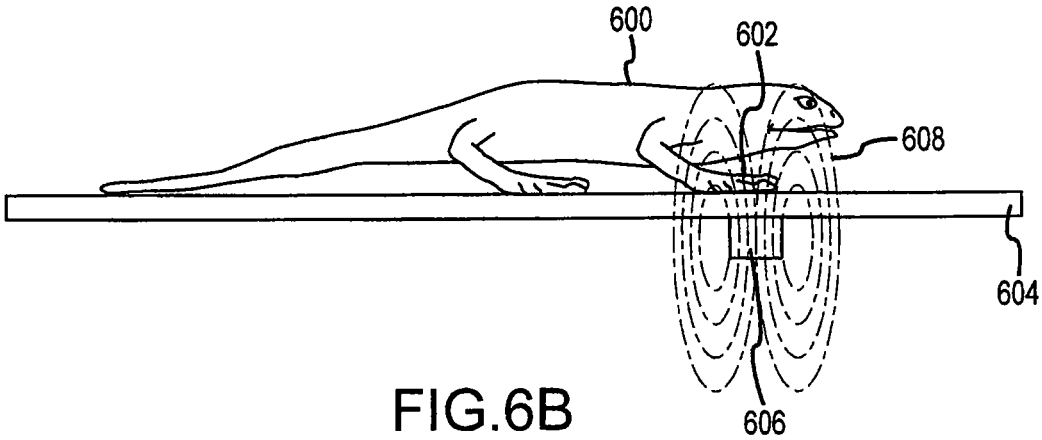
FIG. 6B is a diagram illustrating the animation of the character of FIG. 6A with a magnetic field applied to the inner surface of the display structure.

Similar to the plant objects of FIG. 2, the character 600 object may be mounted on a display structure 604 for display of the creature or to provide portability of the object. Further, the structure 604 may assist in animation of the character through magnetism. For example, FIG. 6B is a diagram of the character of FIG. 6A with a drive magnet 606 applied to the inner surface of the structure 604. As the drive magnet 606 is brought near the inner surface, the magnetic field 608 produced by the magnet may pass through the display structure 604 and attract the iron particles within the flexible material of the character.

In the example shown, the lizard 600 may be molded such that the lizard's leg 602 may be biased away from the structure 604. This biasing of the lizard's leg 602 may be done during casting of the character. Thus, when no magnetic forces are acting on the character 600, the leg 602 of the lizard may be oriented such that some amount of space is provided between the leg and the display structure 604. Further, the lizard's leg 602 may be constructed, at least partially, from a flexible, iron-infused material. When the drive magnet 606 is positioned against the inner surface of the structure 604, the iron particles embedded within the lizard's leg 602 may be attracted to the magnetic field 608 of the magnet 606 and move towards the magnet. The interaction of the embedded particles and the magnet 606 may provide the animation of the lizard placing its leg on the surface, or provide the appearance that the lizard is taking a step on the display structure 604.

In this manner, the character 600 may be animated using magnetism interacting with flexible, iron-infused portions of the character. This animation may be similar to the animation of the plant-like objects described above. Similarly, the magnet configurations described above may also be used in conjunction with the character object. For example, the drive magnet 606 of FIG. 6B may be a hard magnet or may be an electromagnet as described above with reference to FIGS. 5A-5C. Further, the drive magnet 606 may be placed near the inner surface of the display structure 604 manually by an operator as desired to animate the lizard's leg 602, or any part of the character 600 that may be constructed using a flexible, iron-infused material. In other implementations, the magnet 606 may be moved mechanically or, in the case of the electromagnet, the magnet may be switched on and off, or any amount of magnetic field in between, to create the magnetic field as desired herein. Further, the activation of the electromagnet may be performed manually or through a computing device.

In other implementations, the animation of the character's leg 602 may react, not in attraction to the magnet 606, but in repulsion. In these implementations, the iron or other magnetic particles blended with the flexible material may be polarized to a certain polarity prior to being blended with the material. For example, the flexible material may be blended with neodymium particles that may have a positive polarity. To create the repulsion animation of the character, a positively polarized drive magnet may be introduced as described above. In this manner, the character's leg 602 may move away from the surface of the display structure as the neodymium particles are repulsed by the negative magnet, rather than being attracted to the magnet. Generally, however, the configuration of the implementations may remain the same when implementing a repulsion animation.

Figure 7:
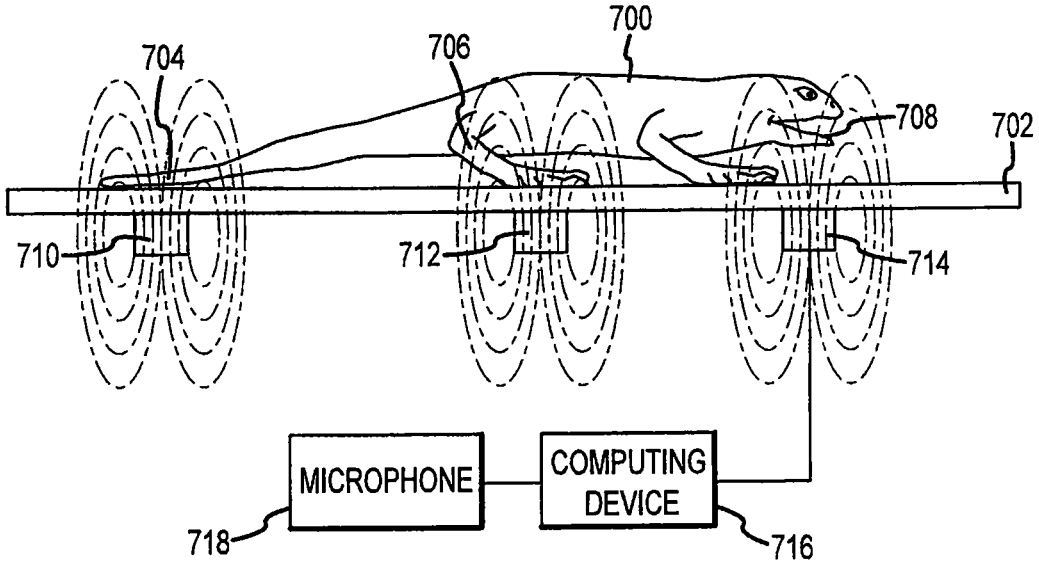
FIG. 7 is a diagram illustrating a character object constructed from iron-infused, flexible material mounted on a display structure that includes several magnets to independently animate separate portions of the character.

Along with the animation of the character's leg described in FIGS. 6A-6B, other portions of the character may also be animated using magnetism. FIG. 7 is a diagram illustrating a character 700 mounted on a structure 702 that includes several drive magnets to independently animate separate portions of the character. In this example, the lizard 700 may be mainly constructed of a silicone or other flexible material. However, portions of the lizard 700, such as the lizard's tail 704, the lizard's foot 706 and the lizard's mouth 708, may be constructed of a flexible iron-infused material that is bonded to the main section of the lizard. Thus, when a magnetic field is introduced near these portions of the character 700, the iron particles embedded in the material may react to the magnetic fields.

Coupled to the display structure 702 may be several drive magnets 710-714 that may be activated to control the animation of the portions of the character 700. For example, a tail magnet 710 may be located underneath the tail portion 704 of the lizard 700, on the inner surface of the display structure 702. When activated, the magnet 710 may apply a magnetic force on the iron particles within the tail and cause the tail to press against the surface of the structure. When molded, the tail 704 of the lizard 700 may be biased away from the surface of the structure 702 to provide space to animate the tail when the iron particles react to the magnetic field. Thus, when the magnetic field is removed, the tail 704 may return to its biased position. In this manner, the introduction and removal of the magnetic field with the tail 704 may cause the tail to move up and down. The activation of the drive magnet 710 may include moving a hard magnet near the inner surface of the display structure 702 or activating an electromagnet located near the inner surface. The deactivation of the drive magnet may include removing the hard magnet or deactivating the electromagnet.

Similar configurations may be utilized to animate the lizard's foot 706 and the lizard's mouth 708. Thus, a foot drive magnet 712 may be located on the inner surface of the display structure 702 underneath the lizard's foot 706 and a mouth magnet 714 may be located on the structure 702 underneath the lizard's mouth 708. The activation and deactivation of these magnets may cause the lizard's leg 706 and mouth 708 to animate in a similar manner as that of the lizard's tail 704. In one implementation, the magnetic field of the mouth magnet 714 may be introduced near the lizard's mouth 708 to simulate the lizard speaking. As shown in FIG. 7, when a magnet 714 is introduced near the mouth 708 of the lizard 700, the mouth may open (as compared to a closed position shown in FIGS. 6A and 6B). Further, the lizard's leg 706 and mouth 708 may be molded in such a manner that these portions of the lizard are biased away from the outer surface of the display structure.

Further, the separate sections of the lizard 700 may include different densities of iron particles, similar to the character of FIG. 1. For example, the tail 704 of the lizard may be composed of several sections, each section with a different density of iron-infused flexible material. Some sections may include a high density of iron particles to provide a strong attraction to the tail magnet 710, particularly those sections that do not need to be very flexible. Other sections of the tail may include a smaller density of iron particles, particularly those sections that do not need a strong attraction to the magnet 710 or may need to be very flexible to achieve the desired animation.

In another implementation, the mouth magnet 714 may be coupled to a computing device 716 that may receive sounds and translate those sounds into movement of the character's mouth 708. For example, the computing device may receive sounds spoken into a microphone 718 by an operator or from some other source. These sound waves may be translated by the computing device 716 into control signals that the computer may use to control the activation of the mouth magnet 714. Thus, as the operator speaks into the microphone 718, the computing device 716 may send a signal to the mouth magnet 714 to activate, thereby creating a magnetic field of the electromagnet. When no magnetic field is present, the mouth may be in a first position, such as a closed position, similar to FIGS. 6A and 6B. When activated, magnetic field of the magnet may attract the iron particles within the mouth portion 708 of the character 700 to cause the mouth of the character to move to a second position, such as an open position. Similarly, when the operator is not speaking, the mouth portion 708 of the lizard 700 may return to the second position, such as a closed or more closed position. In this manner, the character 700 may appear to be speaking the words that the operator is speaking into the microphone 718. Other implementations may use the computing device 716 to control the strength of the magnetic field of the mouth magnet 714. In these implementations, the character's mouth may perform a range of movements to provide a more realistic sense of the character speaking.

Figure 8A:
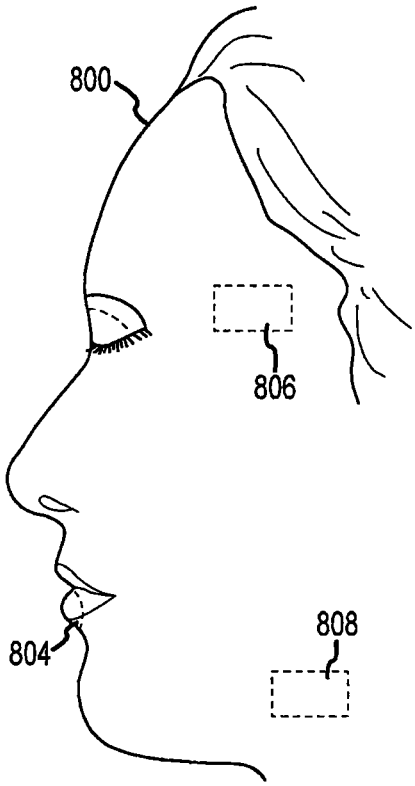
FIG. 8A is a diagram illustrating a cross-section of a head of a character object at least partially constructed from iron-infused, flexible material.
Figure 8B:
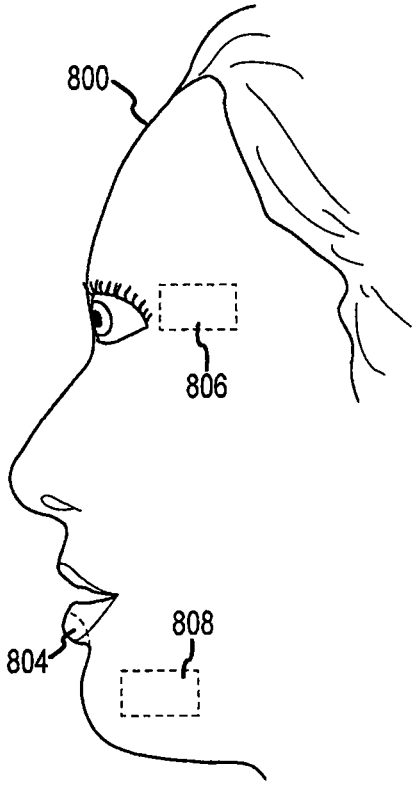
FIG. 8B is a diagram illustrating the cross-section of the character object of FIG. 8A with magnets located within the head to control some facial movements of the character.

Another implementation may use magnetism to create facial movements on a face of character constructed from silicone or other flexible material. For example, FIG. 8A is a diagram illustrating a cross-section of a head of a character with drive magnets positioned within the head to control some facial movements of the character. In this example, drive magnets 806,808 may be positioned within the head 800 of the character, behind portions of the character that are constructed from iron-infused flexible material. For example, the character's eyes 802 and lips 804 may be constructed using flexible iron-infused material. These portions may be bonded to the rest head constructed of un-blended silicone or other flexible material. As shown in FIG. 8B, when the drive magnets 806,808 within the head 800 are activated, the magnetic fields created by the magnets may cause the eyes and lips of the character to move as the iron particles are attracted to the generated magnetic field. In this manner, the facial features 802,804 of the character 800 may be animated by activating and deactivating the magnets 806,808. The magnets 806-808 may take any configuration as described above. Further, any number of magnets may be utilized to animate the many features of the character's face 800.

Figure 9A:
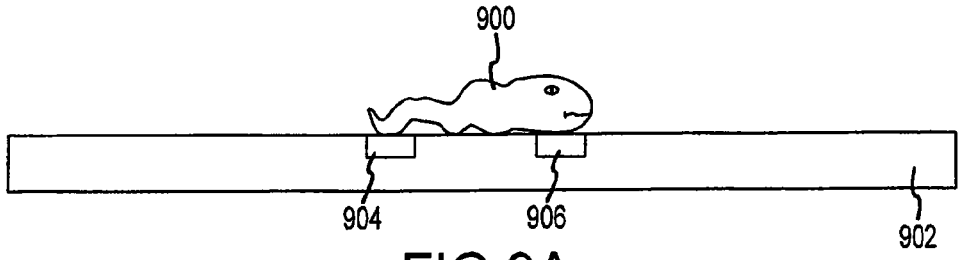
FIGS. 9A-9C are diagrams illustrating a character constructed of iron-infused flexible material being stretched using magnets.
Figure 9B:
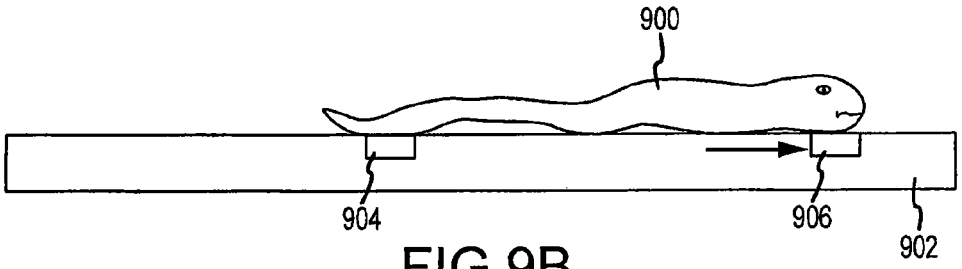
Figure 9C:
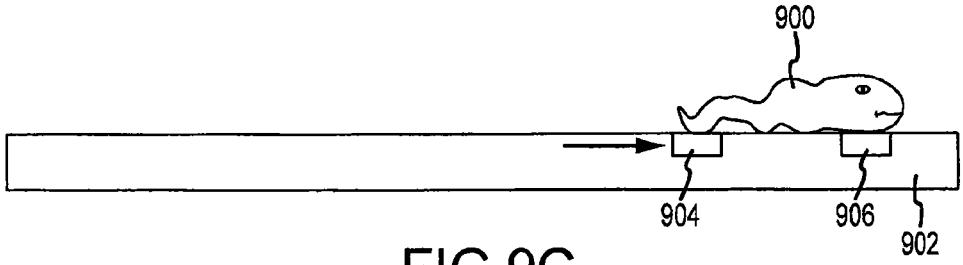

In another implementation, magnetism may be used to stretch or shrink an object composed of iron-infused flexible material. For example, FIGS. 9A-9C are diagrams illustrating a character composed of iron-infused flexible material being stretched and animated using magnetism. The configuration of the implementation may be similar to the implementations described above. Thus, the character 900 may be mounted on a display structure 902 with magnets 904,906 located on the inner surface of the structure. Further, similar to the above implementations, the drive magnets may be moved along the inner surface of the structure, manually, mechanically or programmably, to animate the character 900.

In FIG. 9A, two drive magnets 904,906 may be located on the inner surface of the display structure 902 in a beginning position. The magnetic fields of the magnets 904,906 may interact with the iron particles embedded within the character, in this case a worm, in the following manner to stretch or otherwise animate the character 900. To begin stretching the character 900, the front magnet 906 may be slid across the inner surface of the structure 902. FIG. 9B is a diagram illustrating the character 900 stretching as the front magnet 906 is slid along the inner surface of the structure 902. The iron particles embedded in the flexible material of the character 900 may be attracted to the magnetic field of the front magnet 906. Thus, as the front magnet 906 slides along the inner surface of the structure 902, the front portion of the worm 900 may slide along the outer surface of the structure in response. Further, the worm 900 may stretch as it slides along the outer surface. This stretching may occur because the iron particles of the back portion of the worm 900 may be attracted to the stationary back magnet 904 while the front of the worm slides forward along the outer surface. To further provide for this movement, the middle section of the worm 900 may not include any iron particles blended with the base material. This may prevent the middle section of the worm 900 from being attracted to either the front magnet 906 or the back magnet 904.

In FIG. 9C, the same sliding motion may be applied to the back magnet 904. Thus, as the back portion of the worm 900 follows the movement of the back magnet 904, the back end may also slide across the outer surface of the display structure 902, similar to the front portion in FIG. 9B. Further, because the front magnet 906 is stationary, the front portion of the worm 900 may not move as the back portion slides forward. As can be seen, this combination of movement of the magnets 904-906 may cause the worm 900 to inch forward by alternating the movement of the front magnet and the back magnet.

Figure 10A:
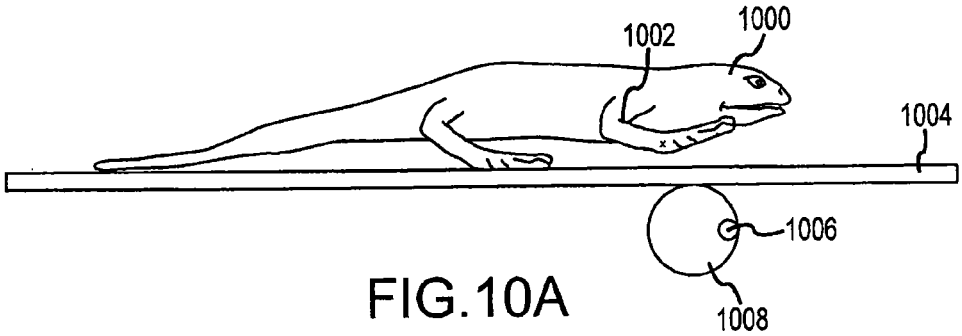
FIG. 10A is a diagram illustrating a character constructed of iron-infused flexible material mounted on a display structure that includes a magnet coupled to a roller device on the inner surface of the structure.
Figure 10B:
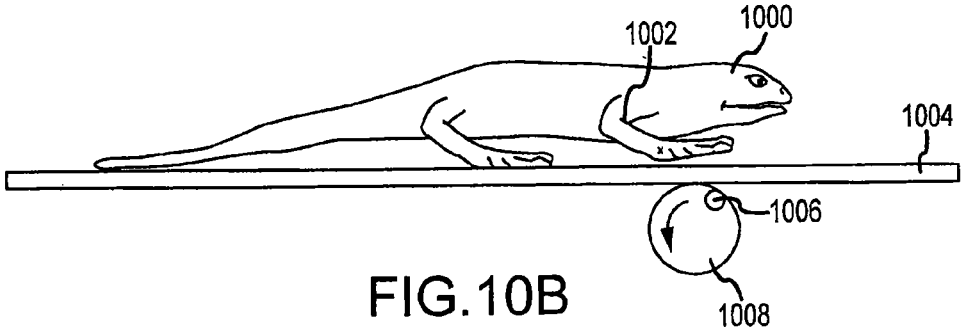
FIG. 10B is a diagram illustrating the leg of the character of FIG. 10A moving in response to magnet coupled to the roller device as the roller device spins.
Figure 10C:
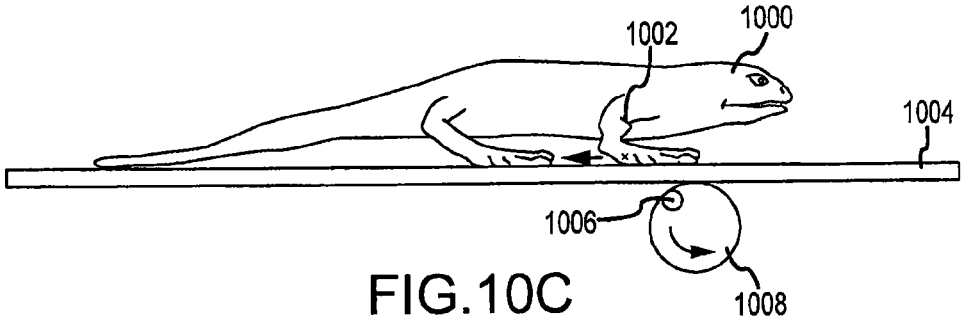
FIG. 10C is a diagram illustrating the leg of the character of FIGS. 10A and 10B following the path of the magnet as the roller device spins.

Magnetism may also be used to provide more complex movements and animation of a character. For example, FIGS. 10A-10C are diagrams illustrating utilizing magnetism for creating a stepping animation of a character. The character 1000 illustrated is the same lizard illustrated in FIGS. 6A-7. However, the character 1000 may be one of many characters made of an iron-infused, flexible material as described herein.

The configuration of this implementation may be similar to that of FIGS. 6A and 6B. Thus, the character 1000 may be mounted on an outer surface of a display structure 1004. However, in this implementation, the drive magnets located on the inner surface of the structure 1002 may be included on a roller mechanism 1008, as shown in FIG. 10A. Thus, as described in more detail below, the character's leg 1002 may react to the drive magnet 1006 located on the roller 1008 on the inner surface the structure 1004 to create the sense that the character is walking along the surface of the structure.

The roller 1008 located on the inner surface of the structure 1004 may include an off-center magnet 1006 such that, as the roller spins along an axis parallel to the inner surface of the structure, the magnet may draw near the inner surface of the structure and then away from the surface. Several rollers 1008 may be located on the inner surface of the structure to provide several points of animation to the character 1000.

Similar to the flexible character of FIG. 6A, the leg 1002 of the lizard 1000 may be biased away from the structure 1004 and in a forward position. As shown in FIG. 10B, the roller 1008 may be rotated such that the magnet 1006 coupled to the roller approaches the inner surface of the structure 1004. As the magnet 1006 approaches the inner surface, the iron particles embedded within the leg 1002 of the character may be attracted to the magnet and may draw the leg of the character toward the outer surface of the display structure 1002. This animation of the character 1000 is similar to the motion described in FIGS. 6A and 6B above.

As shown in FIG. 10C, the roller may continue to rotate and move the magnet 1006 toward the back of the lizard 1000. Similar to the inch worm example above, as the magnet 1006 slides along the inner surface of the structure 1004, the embedded iron particles of the leg 1002 of the character 1000 may continue to react to the magnetic fields of the magnet, pulling the leg toward the back of the character while maintaining contact with the outer surface of the structure.

Figure 10D:
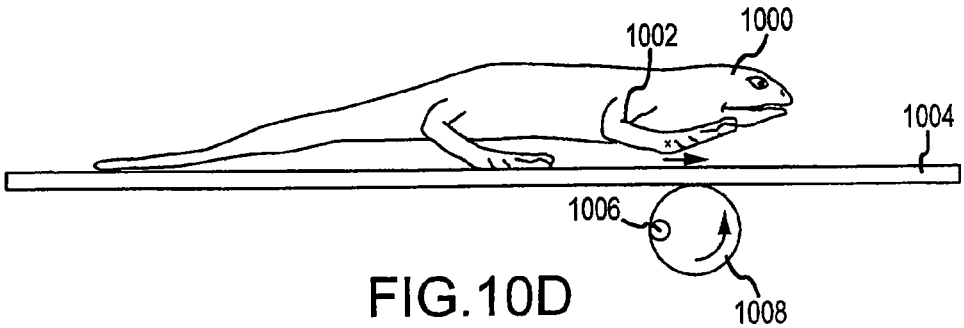
FIG. 10D is a diagram illustrating the leg of the character of FIGS. 10A-10C return to a first position as the magnet is drawn away from the inner surface of the structure.

In FIG. 10D, the magnet 1006 may rotate away from the inner surface of the structure 1004. As the magnet 1006 rotates away from the lower surface, the magnetic field of the magnet applied to the iron-infused flexible material of the character's leg 1002 may lessen. In response, the iron particles of the leg 1002 may no longer react to the magnet 1006. Further, because of the biasing of the leg 1002 of the character described above in relation to FIG. 10A, the leg may return to the biased position once the magnetic field is removed from the leg. Through these movements, the leg 1002 of the character may be animated by a rotating magnet 1006 to provide the appearance of the character stepping forward. In other configurations, an electromagnet may be used in a similar manner as the hard magnet 1006 coupled to the roller 1008 described above to achieve the motions of the leg 1002.

The above configuration may also be applied to each leg of the character 1000 such that character may appear to move each leg to walk across the surface of the structure 1004. To aid in the appearance of the character walking, a roller 1008 with a corresponding magnet 1006 may be located under each leg 1002 of the character. Further, the magnets of each roller 1008 may be offset from each other by 90 degrees (or other such offset) such that each leg performs the above motions at different times as the character is moved along the outer surface of the structure 1004. Also, to further aid in the movement of the character across the structure 1004, a magnet may also be located beneath the body of the lizard 1000 to interact with the iron particles embedded in the lizard. This magnet may be moved across the inner surface of the structure 1004 to help propel the character along the surface while the legs 1002 are performing the above motions.

Figure 11:
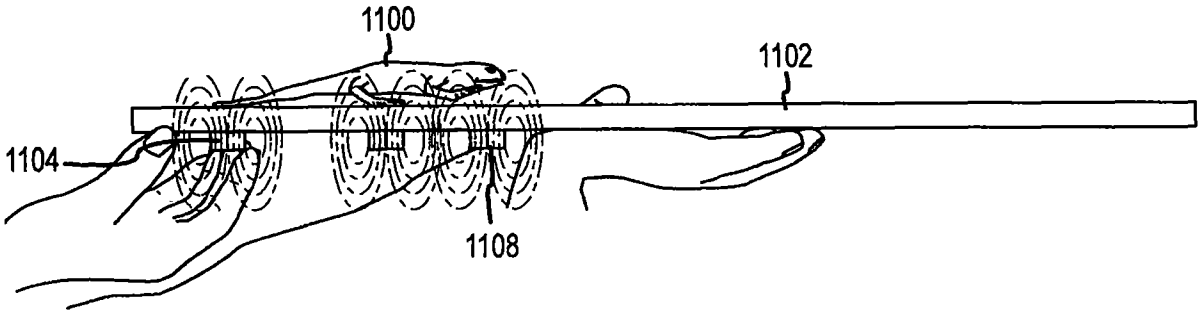
FIG. 11 is a diagram illustrating a portable platform including a character object constructed from iron-infused, flexible material with magnets located beneath the platform to animate the character to entertain a viewer.

The implementations of animating an object constructed of a flexible, iron-infused material described above may be integrated into several various platforms to provide entertainment to amusement park patrons. For example, a mobile platform may provide for the animating of an iron-infused, flexible object using magnetism such that an operator may carry the platform and entertain the patrons of the amusement park. One such mobile platform is illustrated in FIG. 11, including an iron-infused flexible character mounted on a flat display structure that may be portable.

On this platform, the character 1100 may be mounted on a display structure 1102 that may integrate the components of any of the implementations described above. To animate the character to entertain a viewer, an operator may carry the display structure 1102 with one hand and a drive magnet 1104 with the other. The operator may place the magnet 1106 against the lower surface of the structure 1102 in a similar manner as described above to animate the character 1100. In a configuration including an electromagnet 1108, the operator may switch on and off the magnet 1108 at will to animate the character 1100.

The animation of the character may be used to entertain a viewer. For example, the operator may carry the mobile platform to entertain patrons waiting in line to enter a ride or attraction of the amusement park. In another example, the platform may be carried by a waiter in a restaurant to interact with the patrons of the restaurant. Generally, the mobile platform may be carried and operated by an operator to entertain any patron that may encounter the operator.

In another example, the operator may also carry a computing device to control several electromagnets coupled to the lower surface of the structure 1102. The computing device may activate the several electromagnets coupled to the structure 1102 to animate one or more portions of the character, such as the character's leg, tail and mouth. The computing device may also receive voices or environmental noises from a microphone coupled to the computing device. The received noises may cause the computing device to send a signal to the electromagnets located beneath the platform to animate the character in response to the noises. Thus, an operator or assistant may speak into a microphone to cause the mouth of the character to move in accordance. The electromagnet configuration may also be used to entertain the patrons of the amusement park in a similar manner as described above. As should be appreciated, the computing device may communicate with and control the electromagnets wirelessly. Similarly, the microphone may be coupled to the computing device to receive the voices or environmental noises through a wireless connection.

Figure 12:
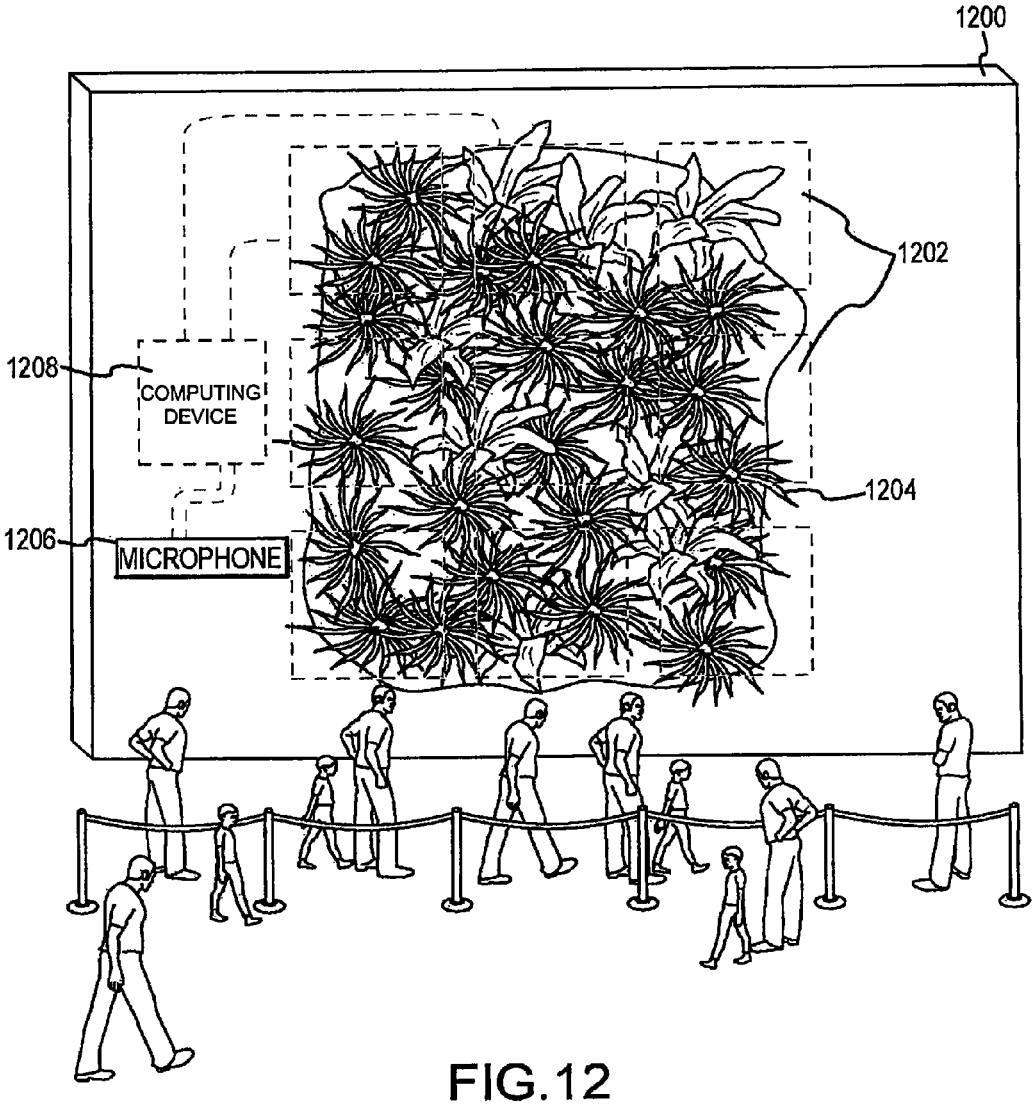
FIG. 12 is a diagram illustrating a static platform including several plant-like objects constructed from iron-infused, flexible material that may be animated using magnets.

In another platform, several objects constructed of iron-infused flexible material may be mounted on a wall or flat display. FIG. 12 is one example of several such objects mounted onto a wall display. Similar to the implementations of the plant-like objects described with reference to FIGS. 2-5A, the objects mounted on the wall 1200 in FIG. 12 may be animated using one or more magnets. For example, several electromagnets 1202 may be coupled to the wall 1200 on the opposite side of the objects 1204. When conducting, the magnets 1202 may create several magnetic fields to cause the objects 1204 to move and animate. By controlling the activation of the several electromagnets 1202, the objects 1204 may be animated to provide the illusion that the objects are reacting to a wave (a "dry for wet" look) or to wind, or may seem alive. The same display may also be mounted underwater to create the illusion of a wave acting on the objects.

In another example, the platform may integrate a microphone 1206 or other measuring device to facilitate the animation of the iron-infused flexible objects 1204 reacting to environmental noises near the display. For example, the objects 1204 may move or alter the animation in reaction to various crowd noises to provide the sense that the wall 1200 is interacting with the crowd. In other examples, the animation may respond to music, light or other environmental conditions. The reactions of the objects 1204 may occur in a similar manner as that of the voice-activated character, i.e. the environmental condition may be detected and measured by a computing device 1208 that may interpret the condition and control the magnetic fields of the magnets 1202 accordingly. Generally, the response of the objects to the environmental conditions may take any form desired by a designer.

Figure 13A:
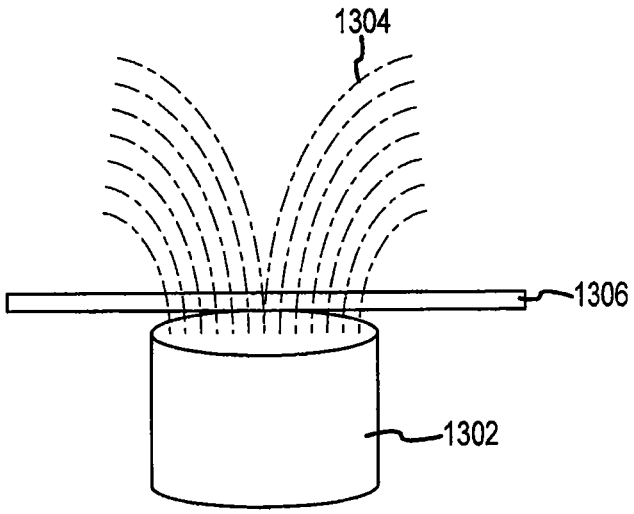
FIG. 13A is a diagram illustrating creating a plant-like object of iron-infused flexible material using the magnetic field of a magnet as a guide.

The reaction of iron particles blended with the flexible material may also be used in the creation of the plant-like objects described above in reference to FIGS. 2-5A. For example, FIG. 13A is a diagram illustrating creating a plant-like object of iron-infused flexible material using the magnetic field of a magnet as a guide. The described technique may be used to make the plant-like objects described in FIGS. 2-5A that may be further animated by a magnetic field of a hard magnet or electromagnet.

To create the plant-like object, a strong earth metal magnet or electromagnet may be utilized. The magnet 1302 may be oriented such that the pole of the magnet is upright, as shown in FIG. 13A. This orientation may create a magnetic field 1304 emanating perpendicular from the top surface of the magnet 1302. On top of the magnet 1302, a flat surface 1306 may be placed, such that the magnetic field lines 1304 propagate perpendicularly through the flat surface. In one embodiment, the flat surface 1306 may be constructed of spring steel or other material that may facilitate the construction of the plant object. The flat surface 1306 may then be painted with a base layer of a flexible material, such as silicone.

Figure 13B:
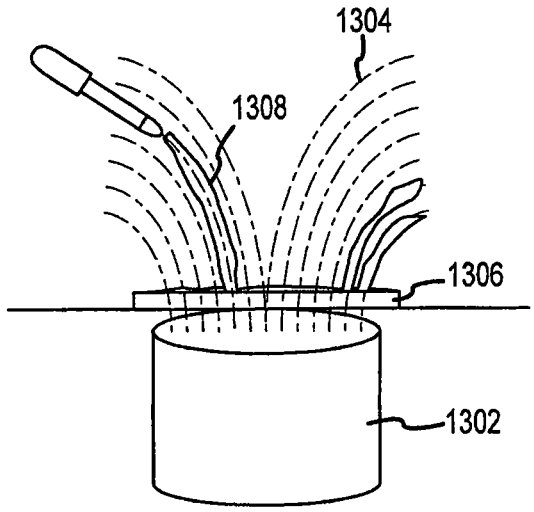
FIG. 13B is a diagram of one of the leaves of the plant-like object of FIG. 13A as created by the magnetic field of the magnet.

Once the base is prepared, the magnetic fields 1304 emanating from the magnet 1302 may be used to create the plant object. In one implementation, an iron-infused flexible material may be heated into a liquid or semi-liquid state. The metal-infused flexible material may be similar to that described above with reference to FIG. 1, such as an iron-infused condensation-cured silicon. As shown in FIG. 13B, the liquid material may be dripped onto or otherwise introduced into the magnetic fields 1304 of the magnet 1302 and onto the flat surface 1306. As the material cures (in some instances, to room temperature), the material may begin to solidify into a shape 1308 that mirrors the magnetic field 1304. In other words, the iron particles blended with the flexible material may take the shape of the magnetic fields emanating from the magnet 1302. Further, the magnetic field 1304 may hold the shape 1308 in response to the iron filings aligning in the magnetic field as the material cures. Once the material has cured and hardened, the object may be removed from the magnetic field 1304. This procedure may be repeated several times to create several blades or leaves of the plant object aligning with several magnetic field lines 1304 of the magnet 1302.

In addition, the plant object may also be painted using an iron-infused paint to color the plant object. For example, the plant object may be kept within the magnetic field 1304 after the object has cured following the procedure described above. A paint blended with iron powder may be created that may interact with the magnetic field. In one example, 2.5 grams of iron powder may be blended with 10 grams of a base paint. Once in the magnetic field 1304 created by the magnet 1302, the iron powder blended with the paint may align with the magnetic field and assist the paint in attaching to the plant object.

The above described implementations may be integrated into several aspects of an amusement park experience. For example, the objects may be part of a ride to entertain patrons as they progress through the ride. Other implementations may be used to entertain guests while waiting in line for various attractions of the park. Further, entire entertainment shows may be created using iron-infused, flexible objects animated by magnetism. Generally, any object that may be imagined by a designer may be constructed of the iron-infused material. Further, the objects may be animated in any manner desired by the designer using one or more magnets applying one or several magnetic fields to the objects.

The foregoing merely illustrates the principles of the invention. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the invention and are thus within the spirit and scope of the present invention. From the above description and drawings, it will be understood by those of ordinary skill in the art that the particular embodiments shown and described are for purposes of illustrations only and are not intended to limit the scope of the present invention. References to details of particular embodiments are not intended to limit the scope of the invention.

What is claimed is:

1. An object for entertaining a viewer comprising:

an at least partially rigid base material comprising at least one flexible portion formed into the shape of the object such that the base material retains the shape of the object; and metal particles blended with the base material in at least a portion of the shape of the object, wherein a plurality of portions of the object contain different densities of metal particles blended with the base material, wherein the metal particles blended with the base material react to a magnetic field generated by a drive magnet positioned near the object, such that the reaction of the metal particles animates at least the at least one flexible portion of the shape of the object.

2. The object of claim 1 wherein the drive magnet is a hard magnet.

3. The object of claim 2 wherein the position of the hard magnet is controlled by a mechanical drive mechanism.

4. The object of claim 1 wherein the drive magnet is an electromagnet configured to generate the magnetic field when the electromagnet is activated.

5. The object of claim 4 wherein the activation of the electromagnet is coupled to and controlled by a programmable computing device.

6. The object of claim 1 wherein the base material is silicone and the metal particles are iron particles.

7. An apparatus for animating a sculpted object comprising:

a display structure defining an inner surface and an outer surface;

a sculpted object coupled to the outer surface of the display structure, the sculpted object at least partially composed from a blend of metal particles and a semi-rigid elastomer material that retains the shape of the object, wherein a plurality of regions of the object contain different densities of metal particles blended with the semi-rigid elastomer material; and at least one drive magnet coupled to the inner surface of the display structure, wherein a magnetic field generated by the at least one drive magnet attracts the metal particles blended with the semi-rigid elastomer material to animate the sculpted object.

8. The apparatus of claim 7 wherein the at least one drive magnet is a hard magnet and further comprising:

a mechanical drive mechanism to mechanically move the hard magnet to generate the magnetic field near the sculpted object.

9. The apparatus of claim 7 wherein the at least one drive magnet is an electromagnet and further comprising:

a programmable computing device to activate the electromagnet to generate the magnetic field.

10. The apparatus of claim 7 wherein the display structure is a portable surface that is carried by an operator.

11. The apparatus of claim 7 wherein the display structure is a wall.

12. The apparatus of claim 9 further comprising:

a microphone coupled to the programmable computing device, the microphone configured to provide a sound input to the programmable computing device;

wherein the programmable computing device controls the activation of the electromagnet in response to the sound input.

13. The apparatus of claim 9 further comprising:

a sensing device coupled to the programmable computing device, the sensing device configured to detect an environmental change near the display structure and provide an input to the programmable computing device indicating the environmental change;

wherein the programmable computing device controls the activation of the electromagnet in response to the input.

14. The apparatus of claim 8 wherein the mechanical drive mechanism comprises:

a roller mechanism configured to roll along the inner surface of the display structure, wherein the at least one drive magnet is coupled to the roller mechanism, offset from the axis of rotation of the roller mechanism.

15. The apparatus of claim 7 further comprising:

a plurality of sculpted objects coupled to the outer surface of the display structure; and a plurality of drive magnets positioned near the inner surface of the display structure, wherein at least one of the plurality of drive magnets generates a magnetic field and attracts the metal particles blended with the semi-rigid elastomer of at least one of the plurality of sculpted objects to animate the at least one sculpted object.

16. The object of claim 1, wherein the reaction of the metal particles causes the at least one flexible portion to bend from a first position to a second position.

17. An entertainment object, comprising:

a first portion formed from a partially flexible base material that substantially retains its shape; and a second portion formed from a mixture of the base material and a plurality of iron particles; wherein the iron particles react to a magnetic field generated by a drive magnet positioned near the object to move the second portion from a first position to a second position while the first portion remains stationary.

18. The entertainment object of claim 17, further comprising a third portion formed from a mixture of the base material and the plurality of iron particles; wherein the third portion has a higher concentration of iron particles than the second portion; and the third portion has a stronger attraction to the drive magnet than the second portion.

19. The entertainment object of claim 18, wherein the base material is silicone.

20. The object of claim 16, the at least one flexible portion returns to the first position from the second position when the drive magnetic is moved away from the object.

* * * * *